US006927534B2

(12) United States Patent
Choi et al.

(10) Patent No.: US 6,927,534 B2
(45) **Date of Patent: *Aug. 9, 2005**

(54) FIELD EMISSION DEVICE

(75) Inventors: Jun-hee Choi, Kyungki-do (KR); Seung-nam Cha, Seoul (KR); Hang-woo Lee, Kyungki-do (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/635,647

(22) Filed: Aug. 7, 2003

(65) Prior Publication Data

US 2004/0027052 A1 Feb. 12, 2004

Related U.S. Application Data

(62) Division of application No. 09/754,275, filed on Jan. 5, 2001, now Pat. No. 6,632,114.

(30) Foreign Application Priority Data

Jan. 5, 2000 (KR) ..... 00-361

(51) Int. Cl.[7] ..... H01J 1/02; H01J 1/62

(52) U.S. Cl. ..... 313/495; 313/309; 313/336; 313/351

(58) Field of Search ..... 313/309, 336, 313/346 R, 351, 311, 495–497

(56) References Cited

U.S. PATENT DOCUMENTS 4,943,343 A 7/1990 Bardai et al.
5,663,608 A * 9/1997 Jones et al. ..... 313/309
5,674,592 A * 10/1997 Clark et al. ..... 428/161
5,726,524 A 3/1998 Debe
5,836,796 A 11/1998 Danroc
5,850,120 A * 12/1998 Okamoto ..... 313/336
5,864,147 A * 1/1999 Konuma ..... 257/10
5,892,321 A 4/1999 Itoh et al.
5,910,704 A * 6/1999 Choo ..... 313/495
5,955,850 A * 9/1999 Yamaguchi et al. ..... 313/495
5,972,235 A 10/1999 Brigham et al.
6,008,062 A 12/1999 Knall
6,020,677 A * 2/2000 Blanchet-Fincher et al. ..... 313/336
6,097,138 A 8/2000 Nakamoto et al.
6,455,989 B1 9/2002 Nakada et al.
6,464,842 B1 10/2002 Golovchenko et al.
6,809,464 B2 * 10/2004 Choi et al. ..... 313/309

* cited by examiner

*Primary Examiner*—Karabi Guharay
*Assistant Examiner*—German Colón
(74) *Attorney, Agent, or Firm*—Burns, Doane, Swecker & Mathis, LLP

(57) ABSTRACT

A field emission device (FED) and a method for fabricating the FED are provided. The FED includes micro-tips with nano-sized surface features, and a focus gate electrode over a gate electrode, wherein one or more gates of the gate electrode is exposed through a single opening of the focus gate electrode. In the FED, occurrence of arcing is suppressed. Although an arcing occurs in the FED, damage of a cathode and a resistor layer is prevented, so that a higher working voltage can be applied to the anode. Also, due to the micro-tips with nano-sized surface features, the emission current density of the FED increases, so that a high-brightness display can be achieved with the FED. The gate turn-on voltage can be lowered due to the micro-tip as a collection of nano-sized tips, thereby reducing power consumption.

6 Claims, 8 Drawing Sheets

FIELD EMISSION DEVICE

This application is a divisional of U.S. patent application Ser. No. 09/754,275, filed on Jan. 5, 2001 now U.S. Pat. No. 6,632,114 which claims priority from Korean Patent Application No. 00-361, filed on Jan. 5, 2000, in the Korean Intellectual Property Office, the disclosure of which is incorporated herein in its entirety by reference.

BACKGROUND OF THE INVENTION

1. Field of the Invention

The present invention relates to a field emission device (FED) which is capable of focusing an electron beam on an anode, and ensures stable operation with high anode voltages, and a method for fabricating the FED.

2. Description of the Related Art

An FED panel with a conventional FED is illustrated in FIG. 1. A cathode 2 is formed over a substrate 1 with a metal such as chromium (Cr), and a resistor layer 3 is formed over the cathode 2 with an amorphous silicon. A gate insulation layer 4 with a well 4*a*, through which the bottom of the resistor layer 3 is exposed, is formed on the resistor layer 3 with an insulation material such as $SiO_2$. A micro-tip 5 formed of a metal such as molybdenum (Mo) is located in the well 4*a*. A gate electrode 6 with a gate 6*a* aligned with the well 4*a* is formed on the gate insulation layer 4. An anode 7 is located a predetermined distance above the gate electrode 6. The anode 7 is formed on the inner surface of a faceplate 8 that forms a vacuum cavity associated with the substrate 1. The faceplate 8 and the substrate 1 are spaced apart from each other by a spacer (not shown), and sealed at the edges. As for color displays, a phosphor screen (not shown) is placed on or near the anode 7.

Since a high-Voltage electrical field is created around micro-UPS in such FEDs, there is the risk of electrical arcing events. Although the cause of electrical arcing is not clearly identified, discharging caused by a sudden large amount of outgassing seems to cause the electrical arcing. According to an experiment result, such arcing occurs with application of an anode voltage as high as 1 kV for both a FED placed within a high-level vacuum chamber without a faceplate, or as a FED vacuum-sealed with a faceplate, as shown in FIG. 1. According to a result of optical microscopy, damage caused by the arcing is mostly detected at the edges of the gate 6*a* of the gate electrode 6. This is considered to be caused by a strong electric field created near such sharp edges of the gate 6*a*. An electrical short occurs between the anode 7 and the gate electrode 6 due to the arcing. As a result, a high-anode voltage is applied to the gate electrode 6, thereby damaging the gate insulation layer 4 below the gate electrode 6, and the resistor layer 3 exposed through the well 4*a*. This damage becomes serious as the anode voltage level increases.

Therefore, the simple configuration of the conventional FED, in which the cathode and anode are spaced apart from each other by just spacers, is not enough to ensure a reliable FED operable with high voltages. The brightness of FED panel depends on the anode voltage level. Thus, a high-brightness FED cannot be manufactured using the conventional FED. The conventional FED cannot focus an electron beam emitted by the micro-tips on the anode, so that it is difficult to achieve a high-resolution display. In addition, a color display with high-color purity cannot be implemented by such a FED.

SUMMARY OF THE INVENTION

To solve the above problems, it is an object of the present invention to provide a field emission display (FED) which ensures stable operation with high anode voltages, and a method for fabricating the FED.

It is another object of the present invention to provide an FED with high-resolution, and with high-color purity for color displays, and a method for fabricating the FED.

According to an aspect of the present invention, there is provided a field emission device (FED) comprising: a substrate; a cathode formed over the substrate; micro-tips having nano-sized surface features, formed on the cathode; a gate insulation layer with wells each of which a single micro-tip is located in, the gate insulation layer formed over the substrate; a gate electrode with gates aligned with the wells such that each of the micro-tips is exposed through a corresponding gate, the gate electrode formed on the gate insulation layer; a focus gate insulation layer having openings each of which one or more gates correspond to, the focus gate insulation layer formed on the gate electrode; and a focus gate electrode with focus gates aligned with the openings of the focus gate insulation layer, the focus gate electrode formed on the focus gate insulation layer.

It is preferable that a resistor layer is formed over or beneath the cathode, or a resistor layers is formed over and beneath the cathode in the FED.

According to another aspect of the present invention, there is provided a method for fabricating a field emission device (FED), comprising: forming a cathode, a gate insulation layer with wells, and a gate electrode with gates on a substrate in sequence, and forming micro-tips on the cathode exposed by the wells; forming a focus gate insulation layer on the gate electrode to have a predetermined thickness with a carbonaceous polymer layer, such that the wells having the micro-tips are filled with the carbonaceous polymer layer; forming a focus gate electrode on the focus gate electrode; forming a predetermined photoresist pattern on the focus gate electrode; etching the focus gate electrode into a focus gate electrode pattern using the photoresist pattern as an etch mask; etching the focus gate insulation layer exposed through the focus gate electrode pattern by plasma etching using $O_2$, or a gas mixture containing $O_2$ for the focus gate insulation layer and a gate for the micro-tips as a reaction gas, thereby resulting in wells in the gas insulation layer; etching the carbonaceous polymer layer within the wells of the gate insulation layer by plasma etching using $O_2$, or a gas mixture containing $O_2$ for the focus gate insulation layer and a gas for the micro-tips as a reaction gas, such that the carbonaceous polymer layer partially remains on the surface of the micro-tips; and etching the surface of the micro-tips by plasma etching using the carbonaceous polymer layer remaining on the micro-tips as an etch mask, and etching the carbonaceous polymer layer itself, using the reaction gas, thereby resulting in micro-tips with nano-sized surface features.

It is preferable that the carbonaceous polymer layer is formed of polyimide or photoresist. The carbonaceous polymer layer may be etched by reactive ion etching (REI). The nano-sized surface features of the micro-tips can be adjusted by varying the etch rates of the carbonaceous polymer layer and the micro-tips. It is preferable that the etch rates are adjusted by varying the oxygen-to-the gas for the micro-chips in the reaction gas, plasma power, or plasma pressure during the etching processes.

Preferable, the micro-tips are formed of at least one selected from the group molybdenum (Mo), tungsten (W), silicon (Si) and diamond. The reaction gas may be a gas mixture of $O_2$ and fluorine-based gas, such $CF_4/O_2$, $SF_6/O_2$, $CHF_3/O_2$, $CF_4/SF_6/O_2$, $CF_4/CHF_3/O_2$, or $SF_6/CHF_3/O_2$. Alternatively, the reaction gas may be a gas mixture of $O_2$ and chlorine-based gas, such $Cl_2/O_2$, $CCl_4/O_2$, or $Cl_2/CCl_4/O_2$.

BRIEF DESCRIPTION OF THE DRAWINGS

The above objects and advantages of the present invention will become more apparent by describing in detail preferred embodiments thereof with reference to the attached drawings in which.

Figure 1:
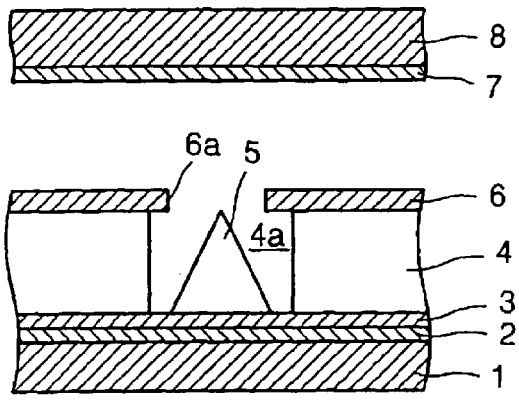
FIG. 1(PRIOR ART)
FIG. 1 is a sectional view of a conventional field emission device (FED)
Figure 2:
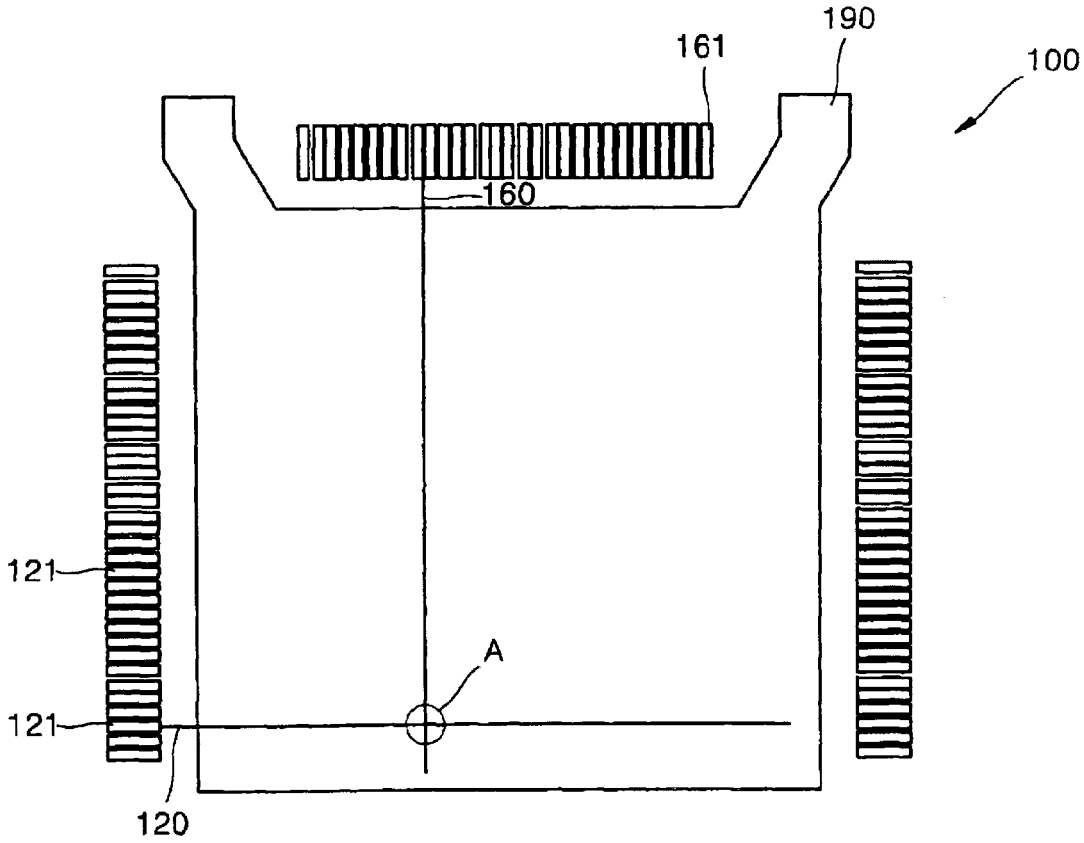
Figure 3:
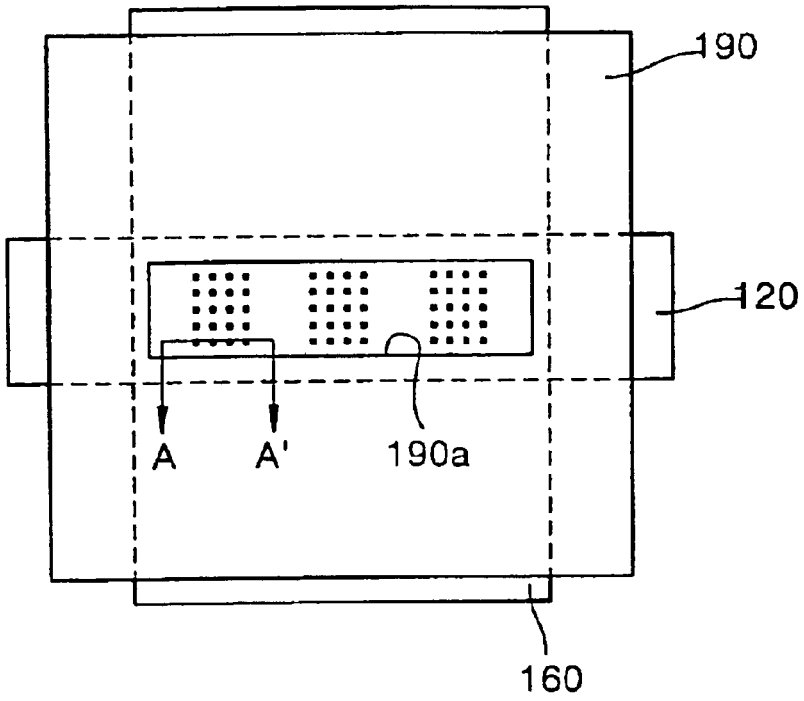
Figure 4A:
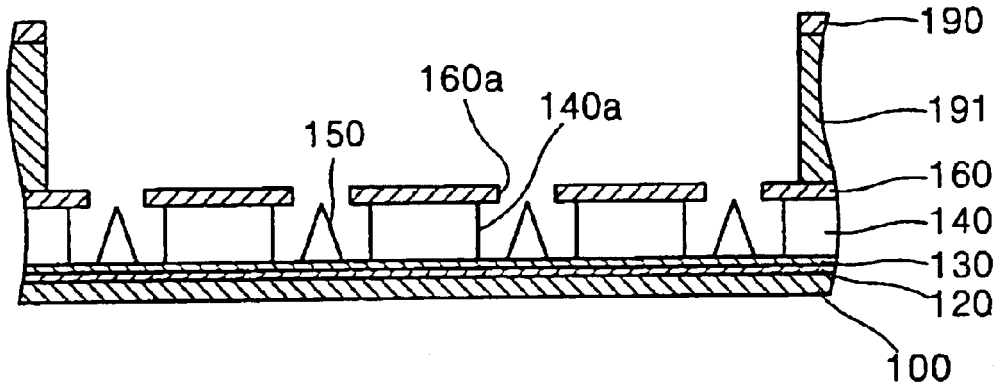
Figure 4B:
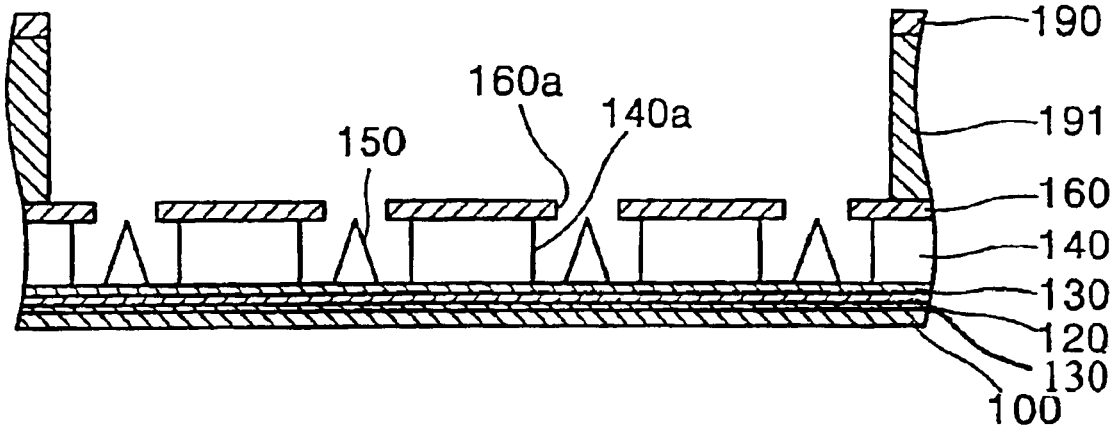
Figure 9:
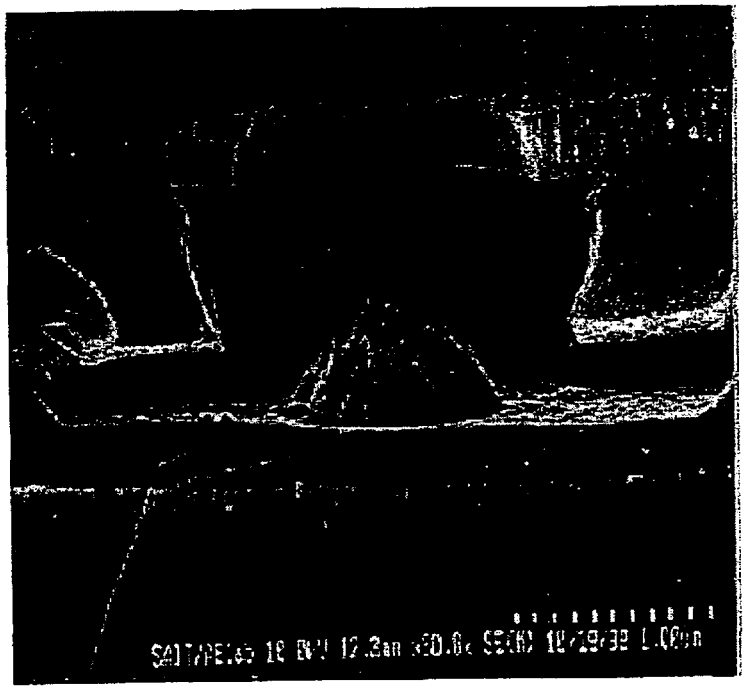
Figure 10:
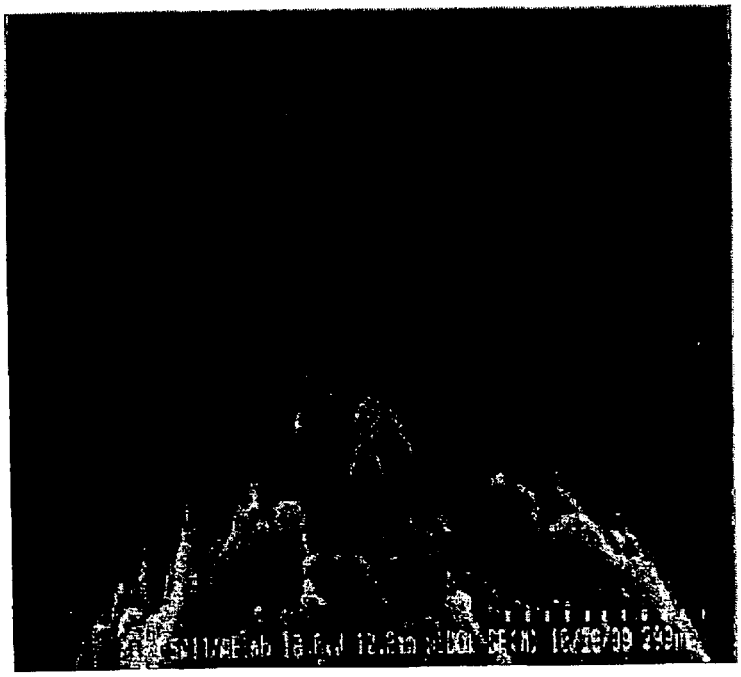
Figure 11:
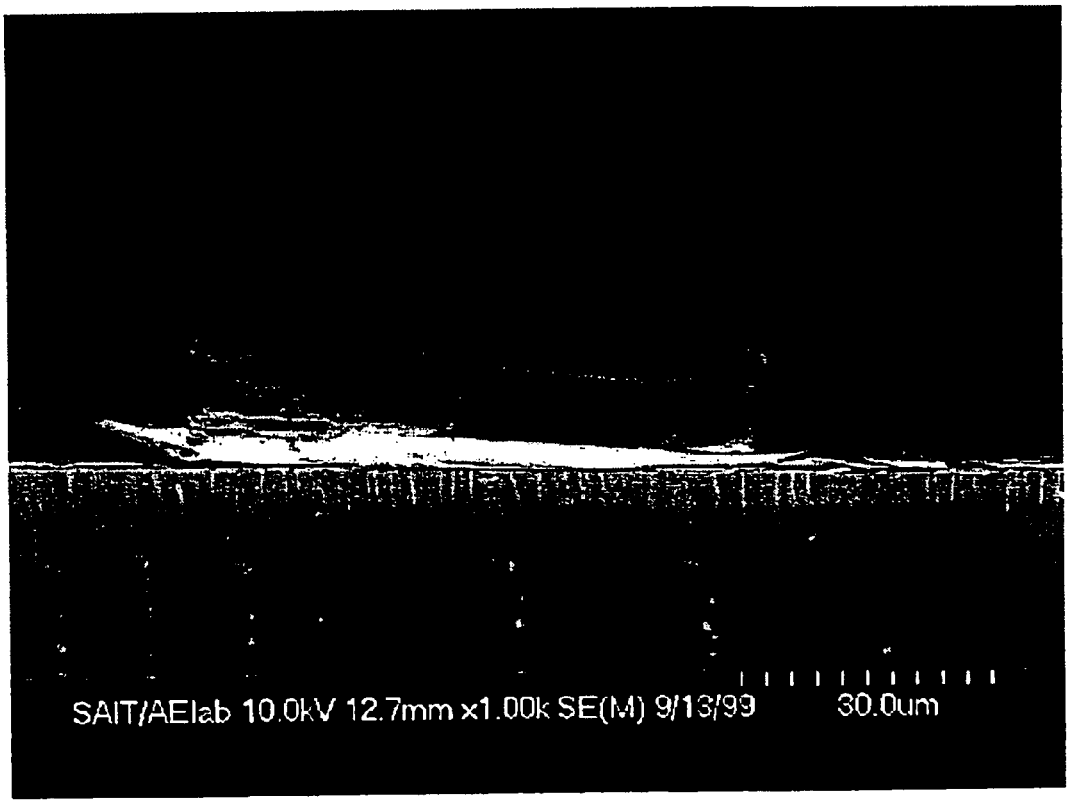

FIG, 2 is a plan view of a preferred embodiment of an FED according to the present invention;

FIG. 3 is a magnified view of the portion A of FIG. 2;

FIG. 4A is a sectional view taken along line A–A' of FIG. 3;

FIG. 4B is an alternative sectional view of FIG. 3;

FIGS. 5 through 8B are sectional views illustrating the fabrication processes of an FED according to a preferred embodiment of the present invention;

FIG. 9 is a scanning electron microscope (SEM) photo showing a section of the FED fabricated by the inventive method;

FIG. 10 is a SEM photo showing the configuration of a micro-tip of the FED of FIG. 9; and FIG. 11 is a SEM photo showing the configuration of the focus gate electrode of the FED fabricated by the inventive method.

DETAILED DESCRIPTION OF THE INVENTION

The present invention will now be described more fully with reference to the accompanying drawings, in which preferred embodiments of the invention are shown. Referring to FIG. 2, which is a plan view of a field emission device (FED) according to the present invention, a cathode 120 and a gate electrode 160 are arranged in a x-y matrix at the center of a substrate 100, and a focus gate electrode 190 that is a feature of the present invention is arranged over the cathode 120 and the gate electrode 160. The cathode 120 and the gate electrode 160 are electrically connected to pads 121 and 161, respectively, arranged on the edges of the substrate 100.

Portion A of FIG. 2 is enlarged in FIG. 3. As shown in FIG. 3, the focus gate electrode 190 has a focus gate 190*a* through which the cross-overlapped portion of the cathode 120 and the gate electrode 160 is exposed. In particular, the gate electrode 160 with the gate 160*a* is exposed through the focus gate 190*a*. The focus gate electrode 190 is located such that the cross-overlapped portion of the cathode 120 and the gate electrode 160, i.e., corresponding to a single pixel, is exposed through its focus gate 190*a*. The distance between the gate electrode 190 and the pads 121 and 161 are determined in the range of 0.1–15 mm, such that the gate electrode 160 and the cathode 120 are fully covered with the focus gate electrode 190. The focus gate electrode 190 is electrically coupled with an external ground, thereby providing electron emission when an arching occurs with a high voltage. As a result, the underlying layers can be protected from damage.

FIG. 4A is a sectional view taken long line A–A' of FIG. 3. Referring to FIG. 4A, a cathode 120 is formed over a substrate 100 with a metal such as chromium (Cr), and a resistor layer 130 is formed over the cathode 120 with an amorphous silicon. A gate insulation layer 140 with a well 140*a*, through which the bottom of the resistor layer 130 is exposed, is formed on the resistor layer 130 with an insulation material such as $SiO_2$. Use of the resistor layer 130 is optional. In other words, formation of the resistor layer 130 may be omitted so that the cathode 120 is exposed through the well 140*a*. Alternatively, the resistor layer 130 can be below the cathode 120, or is formed both over and beneath the cathode 120, as shown in FIG. 4B. A micro-tip 150, which is a feature of the present invention, is formed in the well 140*a* on the resist layer 130 with a metal such as molybdenum (Mo). A micro-tip 150 is a collection of a large number of nano-tips with nano-size surface features. The micro-tip 150 is formed of Mo, W, Si or diamond, or a combination of these materials.

A gate electrode 160 with a gate 160*a* aligned with the well 140*a* is formed on the gate insulation layer 140. A focus gate insulation layer 191 is formed on the gate electrode 160 with polyimide, and the focus gate electrode 190 mentioned above is formed over the focus gate insulation layer 191. The focus gate electrode 190 is formed of Al, Cr, Cr/Mo alloy, Al/Mo alloy, or Al/Cr alloy. The focus gate insulation layer 191 has an opening corresponding to the focus gate 190*a* of the focus gate electrode 190.

In the FED having the above-mentioned configuration, an appropriate voltage is applied to the focus gate electrode 190, so that electric field around the gate 160*a* of the gate electrode 160 becomes weak, thereby preventing arcing at the sharp edges of the gate 160*a*. Although an arcing occurs within the FED, ions generated due to the arcing are collected by the focus gate electrode 190 and then grounded before the cathode 120 or the resistor layer 130 are attacked by the ions. As a result, an electrical short between the cathode 120 and an anode (not shown), as well as a physical damage thereof caused by arcing can be prevented.

An electron beam emitted by the micro-tip 150 can be focused by adjusting the thickness of the focus gate insulation layer 191, such that a small spot can be formed on the anode. In addition, a high-color purity can be achieved for color displays.

The opening of the focus gate insulation layer 191 is formed by reactive ion etching (RIE). In the formation of the opening, the RIE conditions are adjusted to appropriately vary the geometry of the micro-tip 150 exposed through the opening, i.e., to form the micro-tip 150 with nano-sized surface features. By doing so, the gate turn-on voltage can be lowered by more than 30V compared with a convention FED.

Figure 5:
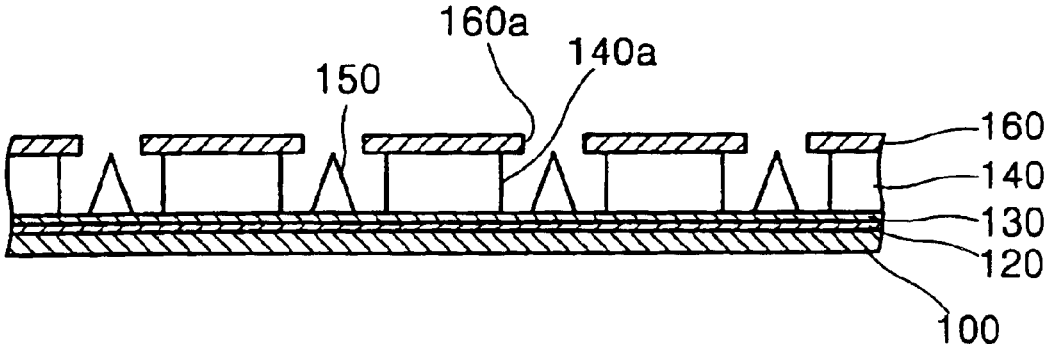

A preferred embodiment of a method for fabricating a FED according to the present invention will be described. Referring to FIG. 5, a cathode 120, a resistor layer 130, a gate insulation layer 140 with a well 140*a*, and a gate electrode 160 with a gate 160*a* are formed on a semiconductor wafer 100 in sequence by a conventional method, and then a micro-tip 150 is formed in the well 140*a* on the resistor layer 130.

Figure 6:
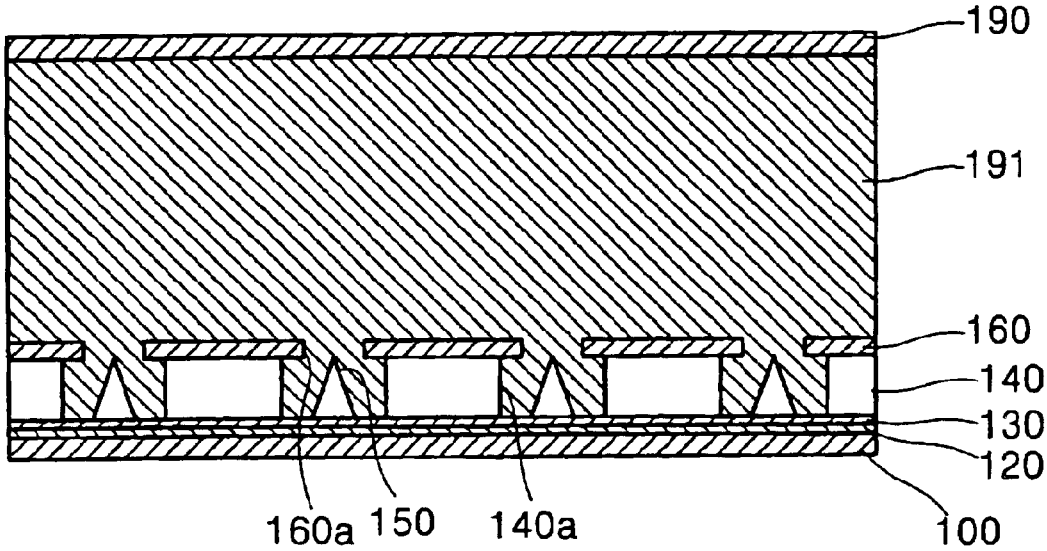

Referring to FIG. 6, polyimide is deposited to have a predetermined thickness over the stack by spin coating, thereby forming a focus gate insulation layer 191. Following this, a focus gate electrode 190 is formed over the focus gate insulation layer 191. The focus gate insulation layer 191 is formed by spin coating, soft baking and then curing, and the thickness of the focus gate insulation layer 191 ranges from 3 to 150 $\mu$m. This range of the thickness will be described in detail below.

Figure 7A:
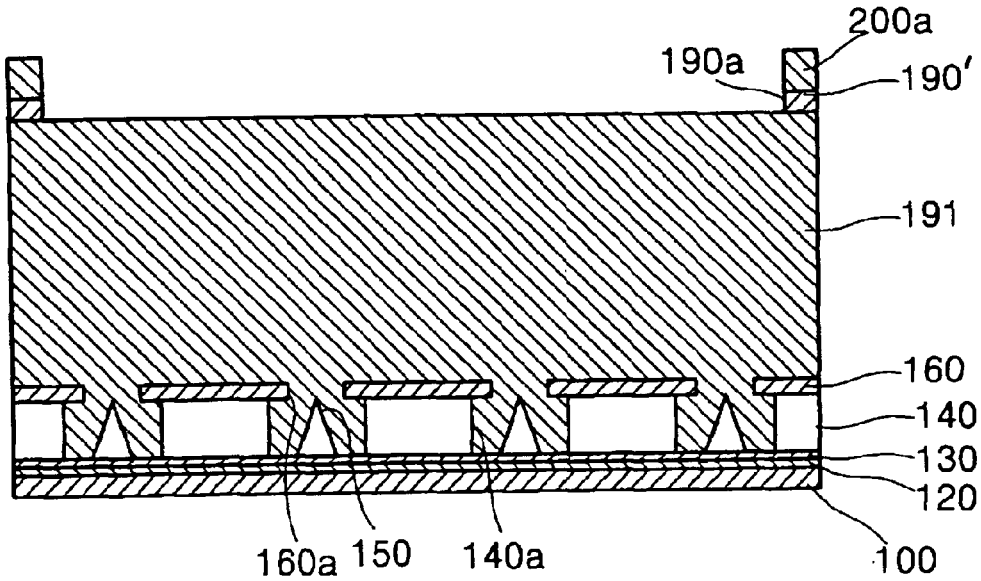
Figure 7B:
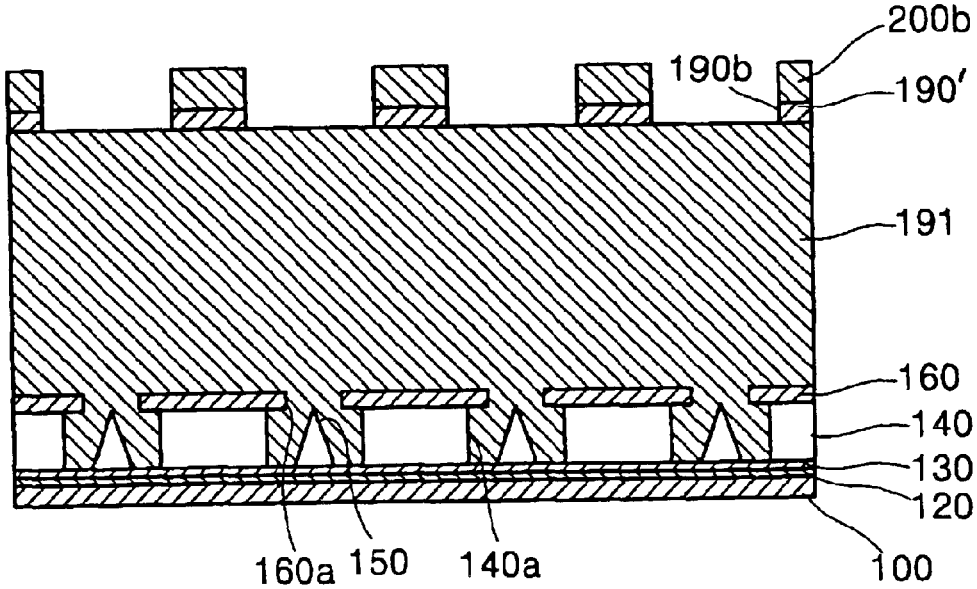
Figure 8A:
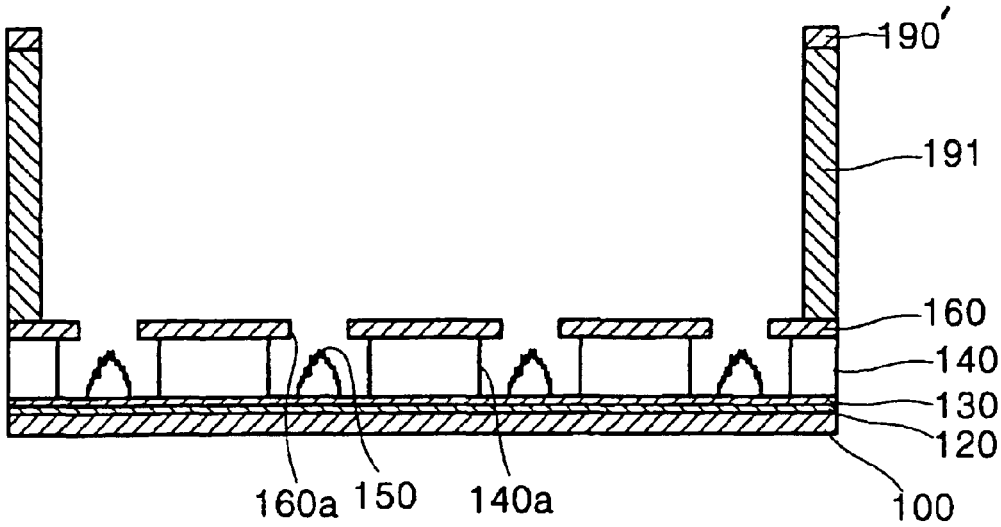
Figure 8B:
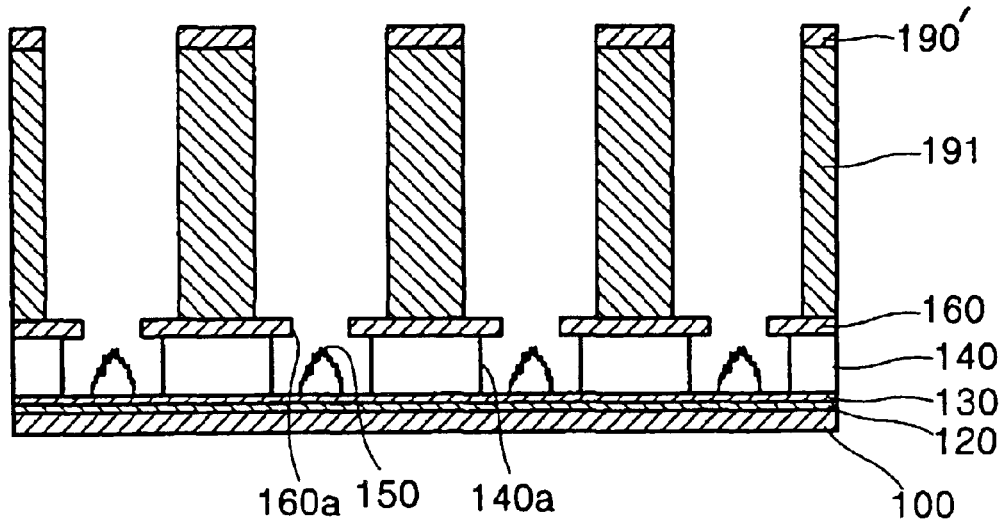

Then, a focus gate 190*a* or 190*b* is formed in the focus gate electrode 190 by photolithography. Referring to FIGS. 7A and 7B, a predetermined photoresist pattern 200*a* or 200*b* is formed on the focus gate electrode 190, and portions of the focus gate electrode 190 which are exposed through the photoresist pattern 200*a* or 200*b* are etched by a general dry or wet etching method using the photoresist pattern 200*a* or 200*b* as an etch mask, thereby resulting in the focus gate 190*a* or 190*b* in the focus gate electrode 190. FIG. 7A illustrates a configuration in which a plurality of micro-tips 160 are exposed through the same single focus gate 190*a*, and FIG. 7B illustrates a configuration in which just one micro-tip 150 is exposed through a single respective focus gate 190*a*. The thickness of the focus gate insulation layer 191 is in the range of 3–150 $\mu$m for the configuration of FIG. 7A, and of 6–50 $\mu$m for the configuration of FIG. 7B. In particular, when each gate 160*a* is exposed through a single respective focus gate 190*a*, the thickness of the focus gate insulation layer 191 may be in the range of 3–10 μm. Alternatively, when 2–4 gates 160*a* are exposed through the same single focus gate 190*a*, the thickness of the focus gate insulation layer 191 may be in the range of 6–50 μm. When a single focus gate 190*a* corresponds to one pixel or dot defined by a cross-overlapped portion between the gate electrode and the cathode, the thickness of the focus gate insulation layer 191 may be in the range of 10–150 μm.

Once the formation of the focus gate 190*a* or 190*b* is completed, the photoresist pattern 200*a* or 200*b* is stripped, and the underlying focus gate insulation layer 191 is etched using the focus electrode pattern 190' as an etch mask. The focus gate insulation layer 191 may be etched by dry etching such as RIE or plasma etching. When a plasma etching method is applied, a gas mixture containing $O_2$ as a major component, and a fluorine-based gas such as $CF_4$, $SF_6$ or $CHF_3$ may be used as a reaction gas. The gas mixture may be $CF_4/O_2$, $SF_6/O_2$, $CHF_3/O_2$, $CF_4/SF_6/O_2$, $CF_4/CHF_3/O_2$, or $SF_6/CHF_3/O_2$. Alternatively, a gas mixture of $O_2$ and a chlorine-based gas, for example, $Cl_2/O_2$, $CCl_4/O_2$, or $Cl_2/CCl_4/O_2$, can be used as a reaction gas.

Reportedly, polyimide layers are etched into a grass-like structure by dry plasma etching using $O_2$. The glass-like structure describes rough surface features of the resulting structure due to different etch rates over regions of the polyimide layer. The addition of $O_2$ to the fluorine-based gas is for increasing the etch rate of the polyimide focus gate insulation layer 191, such that the micro-tip 150 below the focus gate insulation layer 191 can be etched by plasma. The etch rate of the micro-tip 150 by plasma can be adjusted by varying the $O_2$-to-fluorine- or chlorine-based gas ratio in a reaction gas used, plasma pressure, and plasma power in plasma etching the focus gate insulation layer 191. Since the focus gate insulation layer 191 formed of a carbonaceous polymer such as polyimide or photoresist is etched into a grass-like structure, the polyimide or photoresist may randomly remain over the micro-tip 150. The polyimide or photoresist remaining on the micro-tip 150 acts as a mask for a further etching to the micro-tip 150. As the result of the etching, the micro-tip 150 with nano-sized surface features, as a collection of a large number of nano-tips, is formed.

FIG. 9 is a scanning electron microscope (SEM) photo showing the micro-tip, gate insulation layer, and gate electrode formed on the substrate, and FIG. 10 is a magnified view of the micro-tip of FIG. 9. As shown in FIGS. 9 and 10, the micro-tip as a collection of nano-tips has nano-sized surface features, as described previously. As a test result, the gate turn-on voltage of the FED fabricated by the method according to the present invention is reduced by about 20V, and the working voltage (a voltage level at a 1/90 duty ratio and a 60 Hz frequency) is lowered by about 40–50V, compared with a conventional FED. The height of the micro-tip and the size of the nano-tips can be varied by adjusting the etching ratios or etching rates of the focus gate insulation layer formed of a carbonaceous polymer, and the micro-tip during the plasma etching, as described previously. FIG. 11 is a SEM photo of the FED illustrating the sharp vertical sidewalls of an opening in the focus gate insulation layer. As a leakage test result, a resistance between the focus gate electrode and the gate electrode is higher than 10 MΩ.

As previously mentioned, in the FED and the FED fabrication according to the present invention, occurrence of arcing is suppressed. Although an arcing occurs in the FED, damage of the cathode and the resistor layer is prevented. Due to the minimized arcing effect, a higher working voltage can be applied to the anode, compared with a conventional FED. The micro-tips with nano-sized surface features contributes to increasing the emission current density of the FED increases, so that a high-brightness display can be achieved with the FED. The gate turn-on voltage can be lowered due to the micro-tip as a collection of nano-sized tips, thereby reducing power consumption.

According to the present invention, an electron beam emitted by the micro-tip can be focused on the anode through the focus gate of the focus gate electrode by varying a voltage level applied to the focus gate electrode. Even for a display with a considerably long substrate-to-faceplate distance, for example, longer than 3 mm, a high-resolution, and a high-color purity for color displays are ensured.

While this invention has been particularly shown and described with reference to preferred embodiments thereof, it will be understood by those skilled in the art that various changes in form and details may be made to the described embodiments without departing from the spirit and scope of the invention as defined by the appended claims.

What is claimed is:

1. A field emission device (FED) comprising:

a substrate;

a cathode formed over the substrate;

micro-tips having nano-sized surface features, each micro-tip including the nanosized surface features being of a single integral homogeneous material, formed on the cathode;

a gate insulation layer with wells in which a single micro-tip is located, the gate insulation layer formed over the substrate;

a gate electrode with gates aligned with the wells such that the micro-tips are exposed through a corresponding gate, the gate electrode formed on the gate insulation layer;

a focus gate insulation layer having openings to which one or more gates correspond, the focus gate insulation layer formed on the gate electrode; and a focus gate electrode with focus gates aligned with the openings of the focus gate insulation layer, the focus gate electrode formed on the focus gate insulation layer.

2. The field emission device of claim 1, wherein a resistor layer is formed over or beneath the cathode, or resistor layers are formed over and beneath the cathode.

3. The field emission device of claim 1, wherein the micro-tips having nano-sized surface features comprise a plurality of nano-tips.

4. The field emission device of claim 1, wherein a resistor layer is formed beneath the cathode.

5. The field emission device of claim 1, wherein resistor layers are formed over and beneath the cathode.

6. The field emission device of claim 1, wherein two or more gates correspond to an opening in the focus gate insulation layer.

* * * * *